US009382767B2

(12) United States Patent
Hill et al.

(10) Patent No.: US 9,382,767 B2
(45) Date of Patent: Jul. 5, 2016

(54) CANTILEVER CONTAINED DRILLING UNIT UTILIZING VERTICAL TUBULAR CONVEYANCE AND STANDBUILDING SYSTEM

(71) Applicant: Transocean Sedco Forex Ventures Limited, George Town Grand Cayman (KY)

(72) Inventors: Edwin T. Hill, Houston, TX (US); Dennis W. Waddell, Angleton, TX (US)

(73) Assignee: Transocean Sedco Forex Ventures Limited, Grand Cayman (KY)

( * ) Notice: Subject to any disclaimer, the term of this patent is extended or adjusted under 35 U.S.C. 154(b) by 311 days.

(21) Appl. No.: 13/826,218

(22) Filed: Mar. 14, 2013

(65) Prior Publication Data

US 2014/0126979 A1 May 8, 2014

Related U.S. Application Data

(60) Provisional application No. 61/723,182, filed on Nov. 6, 2012.

(51) Int. Cl.
*E21B 19/00* (2006.01)
*E21B 19/14* (2006.01)
*E21B 19/16* (2006.01)

(52) U.S. Cl.
CPC ..... *E21B 19/143* (2013.01); *E21B 19/16* (2013.01)

(58) Field of Classification Search
CPC ..... E21B 19/14; E21B 19/146; E21B 19/161; E21B 19/16; E21B 19/18; E21B 19/20
USPC ..... 414/22.51–22.71; 198/560, 370.5, 456, 198/468.6
See application file for complete search history.

(56) References Cited

U.S. PATENT DOCUMENTS

| | | | | |
|---|---|---|---|---|
| 2,773,605 | A * | 12/1956 | De Jarnett | E21B 19/14 198/560 |
| 2,867,338 | A * | 1/1959 | Simmonds | 414/22.71 |
| 2,946,464 | A * | 7/1960 | Guier | 414/22.68 |
| 5,647,443 | A * | 7/1997 | Broeder | E21B 19/143 166/359 |
| 7,458,476 | B2 * | 12/2008 | Peoples et al. | 211/134 |
| 7,699,122 | B2 * | 4/2010 | Eriksen | 175/52 |
| 2003/0196791 | A1 | 10/2003 | Dunn et al. | |
| 2003/0221871 | A1 | 12/2003 | Hamilton et al. | |
| 2005/0126792 | A1 | 6/2005 | Berry | |
| 2010/0200297 | A1 | 8/2010 | Comacchio et al. | |

* cited by examiner

*Primary Examiner* — Saul Rodriguez
*Assistant Examiner* — Lynn Schwenning
(74) *Attorney, Agent, or Firm* — Norton Rose Fulbright US LLP

(57) ABSTRACT

The invention relates to a method and apparatus for attaching, detaching and conveying tubular on a drill cantilever. The method and apparatus include a tubular standbuilding conveyor assembly and a stand delivery conveyor assembly. The method and apparatus provide for improved movement, assembly and disassembly in order to eliminate inefficient movements and to improve consistent, repeatable performance.

29 Claims, 6 Drawing Sheets

STARBOARD
408
102
202
406
DRILL FLOOR

206

204
200
302
400

210
100

CANTILEVER CONTAINED DRILLING UNIT UTILIZING VERTICAL TUBULAR CONVEYANCE AND STANDBUILDING SYSTEM

CROSS-REFERENCE TO RELATED APPLICATIONS

This Application claims the benefit of U.S. Provisional Application 61/723,182 filed on Nov. 6, 2012, which is hereby incorporated by reference in its entirety.

TECHNICAL FIELD

The invention relates to a structure, system and method for assembling and disassembling tubular in a vertical orientation on a drill floor.

BACKGROUND OF THE INVENTION

Traditionally on Jackup Drilling Units, tubulars are taken from the horizontal position on a pipe deck, up through the V-door, and to a well center by manual handling via cranes, winches, and tuggers. The storage location is not a fixed distance from the well center, as the well center varies according to cantilever skid-out distance and transverse rotary table movement. Some improvements have been made over the years in pipe handling systems such as the introduction of column racking units, horizontal-to-vertical machines, and horizontal conveyors, but the efficiency of the overall functionality of drilling unit is still lacking, in part due to the fact that tubulars are usually stored on the fixed hull, but required on the moveable drill floor. The concept of keeping stored tubulars in a position of permanent fixity with respect to the drill floor has not been previously employed.

Embodiments of this invention streamline tubular handling on offshore drilling units by providing a simple, logical, streamlined system for storing, retrieving, and delivering tubulars in a controlled manner that is both repeatable and consistent. On a cantilever jackup unit, for example, the derrick and well are normally situated on the aft end. By storing pipe vertically, space is saved, and by doing so on the forward end of the cantilever on a jackup unit, the weight of the tubulars is also used as counterweight. The capability to build stands of pipe on the cantilever and then have them delivered vertically by a conveyor directly to the well center reduces risk to personnel by significantly reducing the number of tubulars that must be handled manually. By eliminating unnecessary motions in the process from storage to delivery, the logistical flow improvement translates directly to improved reliability and consistent tripping efficiency.

Embodiments of this invention simplify the processes of transporting and assembling tubulars by eliminating wasted movements. For example, pipe racking system ("PRS") travel time is reduced going from the well center to a setback slot and back again as embodiments of the invention presents tubulars to the well center directly with no wait time. Further, the manual handling of tubulars is dangerous and can be inconsistent. Embodiments of this invention significantly minimizes human interface with moving tubulars and is a major step toward total automation of tubular handling.

BRIEF SUMMARY OF THE INVENTION

The invention is directed to a tubular standbuilding conveyor apparatus that includes a horizontal conveyor belt apparatus running along a horizontal axis; a vertical conveyor belt apparatus oriented parallel to and vertically offset from the horizontal conveyor belt apparatus; a stand building hoist; and an iron roughneck. The horizontal and vertical conveyor belts are configured to convey vertically oriented tubulars along the horizontal axis and the stand building hoist and the iron roughneck are configured to attach a vertically oriented tubular to one or more other vertically oriented tubulars.

The horizontal conveyor belt apparatus is capable of supporting large point loads and includes a steel track shoe belt. The surface of the horizontal conveyor belt apparatus is covered with a protective surface. The protective surface is at least one of wood, nylon or rubber.

The vertical conveyor belt apparatus includes a cogged belt, which is mechanically coupled to the vertical conveyor belt apparatus through a set of right angle drive gears. At least one additional vertical conveyor belt apparatus is located parallel to and vertically offset from the vertical conveyor belt. In one embodiment, there exists at least one additional vertical conveyor belt apparatus. The vertical conveyor belt apparatuses are offset from each other on the horizontal ends of the vertical conveyor belts. The parallel vertical conveyor belt apparatuses are horizontally offset from each other. The vertical conveyor belts are horizontally offset from each other such that when a vertical tubular is on the horizontal conveyor apparatus and leaned against the vertical conveyor belt apparatus, the vertical tubular would be at about a 3 degree angle from a plane running vertically through the horizontal center of the horizontal conveyor apparatus.

The apparatus further includes a stand delivery conveyor assembly configured to convey vertically oriented tubulars to or from the horizontal conveyor belt apparatus. The stand delivery conveyor assembly includes a delivery horizontal conveyor belt apparatus running along the horizontal axis; and at least one delivery vertical conveyor belt apparatus oriented parallel to and vertically offset from the horizontal conveyor belt apparatus. At least one additional vertical conveyor belt apparatus is located parallel to and vertically offset from the vertical conveyor belt.

There is further disclosed a tubular interchange device located between the tubular standbuilding conveyor apparatus and the stand delivery conveyor assembly, wherein the tubular interchange device is configured to convey vertically oriented tubulars from the horizontal conveyor belt apparatus to the stand delivery conveyor assembly.

In one embodiment, there is included a drill rig containing the tubular standbuilding conveyor apparatus described above located on a moveable drill floor. The drill rig includes a vertical tubular setback area located forward of the tubular standbuilding conveyor apparatus and a vertical assembled tubular setback area located aft of the tubular standbuilding conveyor apparatus and in proximity to the well center. A lower level bridge crane assembly is also included in which the lower level bridge crane assembly is configured to move a tubular from the setback area to the tubular standbuilding conveyor apparatus. An upper level bridge crane assembly is further included. The stand building hoist is attached to the upper level bridge crane assembly. The iron roughneck may also be attached to the upper level bridge crane assembly. An additional tubular standbuilding apparatus is included in which each tubular standbuilding apparatus is oriented such that the horizontal conveyor belt apparatus is inboard of the vertical conveyor belt apparatus. Though this embodiment is directed toward a moveable drill floor, a person skilled in the art would recognize that the design is equally applicable to a fixed drill floor.

A method for providing tubular assembly includes the steps of loading at least a first and a second vertically oriented tubular onto a conveyor assembly; raising the first tubular above the second tubular; and attaching the first tubular to the second tubular. The step of raising the first tubular is done with a standbuilding hoist. Attaching the first tubular to the second tubular is done with an iron roughneck. A method for providing tubular disassembly includes the steps of removing at least two attached tubulars from a well center; loading the attached tubulars onto a vertical conveyor assembly; separating the attached tubulars; and lowering the top most separated tubular onto the vertical conveyor assembly. A further step is conveying the separated tubulars to a storage setback using the vertical conveyor assembly in which separating the attached tubular is done with an iron roughneck and the lowering is done with a standbuilding hoist.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

Further, a structure (e.g., a component of an apparatus) that is configured in a certain way is configured in at least that way, but it can also be configured in other ways than those specifically described.

The Cantilever Contained Drilling Unit (CCDU) includes a Vertical Tubular Conveyance and Storage System (VTCSS). While these are two distinct subjects, they are part of the overall concept of a drilling unit with an improved logistical flow of tubulars. "Cantilever Contained" means that all processes and equipment required in the drilling process are located within the cantilever structure. While it is recognized that not every single piece of equipment in support of drilling can be located on or in the cantilever, the critical pieces that require fixity with respect to the well center are given priority in order to improve efficiency of processes. In an embodiment of the invention, standbuilding and conveyance are given priority. While not mentioned, mud systems, wireline, and cementing may also be included in the outfitting of the cantilever.

Since handling of tubulars is fixed with respect to the well center, the facilities and processes for storage, movement, assembling and disassembling can be optimized to eliminate inefficient movements and improve consistent, repeatable performance in an assembly-line type system.

Detail of the Cantilever Contained Drilling Unit

The Cantilever Contained Drilling Unit (CCDU) improves efficiency in the handling of tubulars on jackup rigs. This solution places all tubulars in a position of permanent fixity with respect to the well center. Assuming that some means of longitudinal and transverse cantilever movement is employed, the well center on the drill floor is fixed. This then allows for an efficient system of tubular conveyance to be utilized, which will minimize unnecessary movement in the process of delivering tubulars in multiple sizes, such as sizes ranging between 2-⅞"-6-⅝" drill pipe, as well as all casing sizes up to and including 13-⅝". Irregular and repetitive time consuming movements are eliminated as much as possible while at the same time the human interface in this conventionally high risk environment is significantly reduced.

Figure 1:
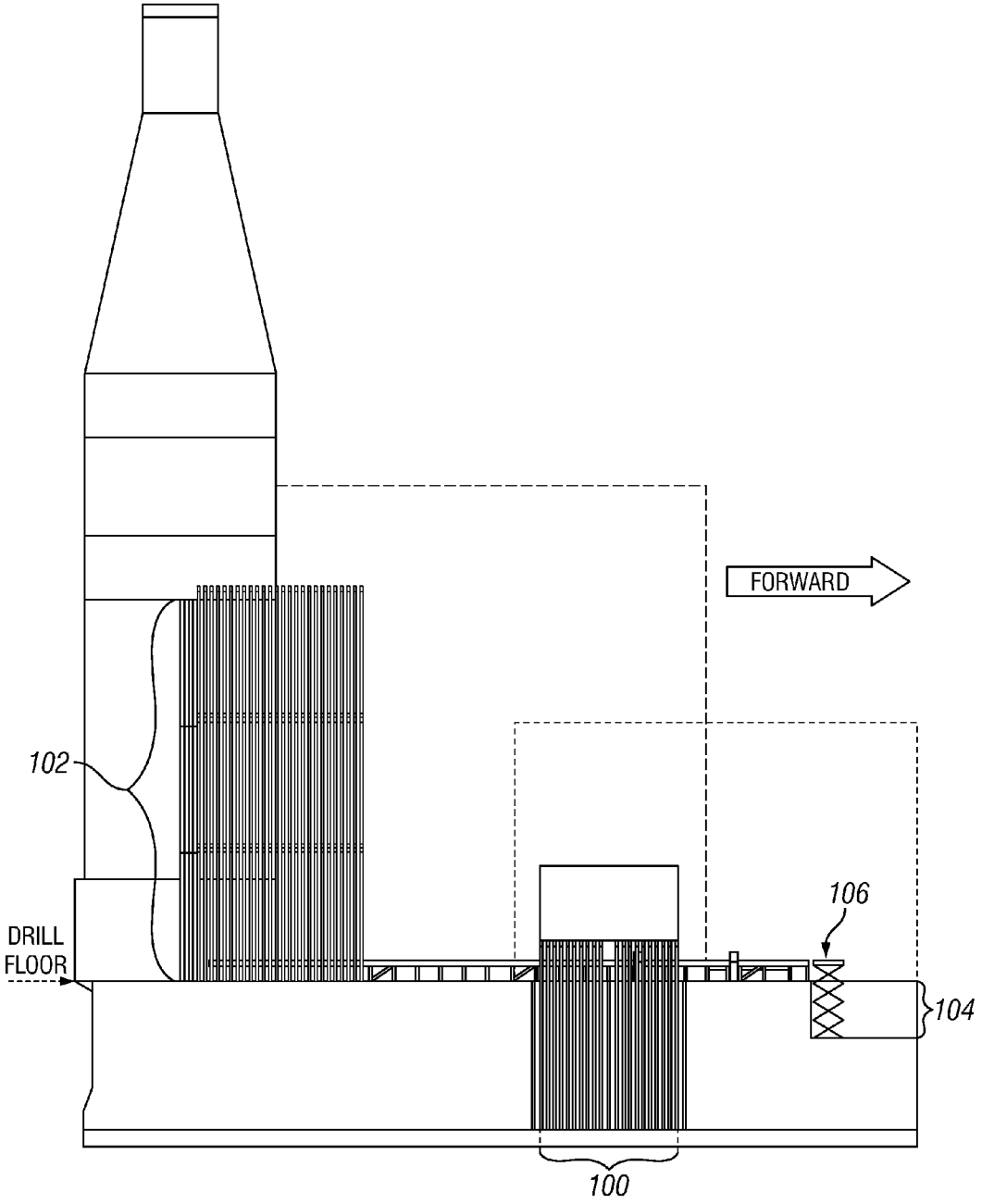
FIG. 1 is a profile view of a rig illustrating an embodiment of pipe storage and setback.

FIG. 1 illustrates an embodiment of drill pipe storage (tubular storage). The CCDU may be sized to accommodate the vertical storage of 35,000 feet of 6-⅝" drill pipe and 30,000 feet of 9-⅝" casing in vertical tubular holds on the cantilever. However, the space requirements may be sized according to space available. Adjustable fingerboards in the tubular holds will allow for the storage of other tubular sizes in varying quantities. The vertical tubular holds may be capable of storing both single joints and double joints of drill pipe, and single joints of casing. Tubulars may be prepared and inspected prior to placement into the vertical storage holds. Unless otherwise specified, movement of tubulars into and out of the holds will be via conventional crane handling. Tubulars can be stored in a doubles setback area 100 and once assembled can be stored in the setback area 102, next to the well center.

Figure 2:
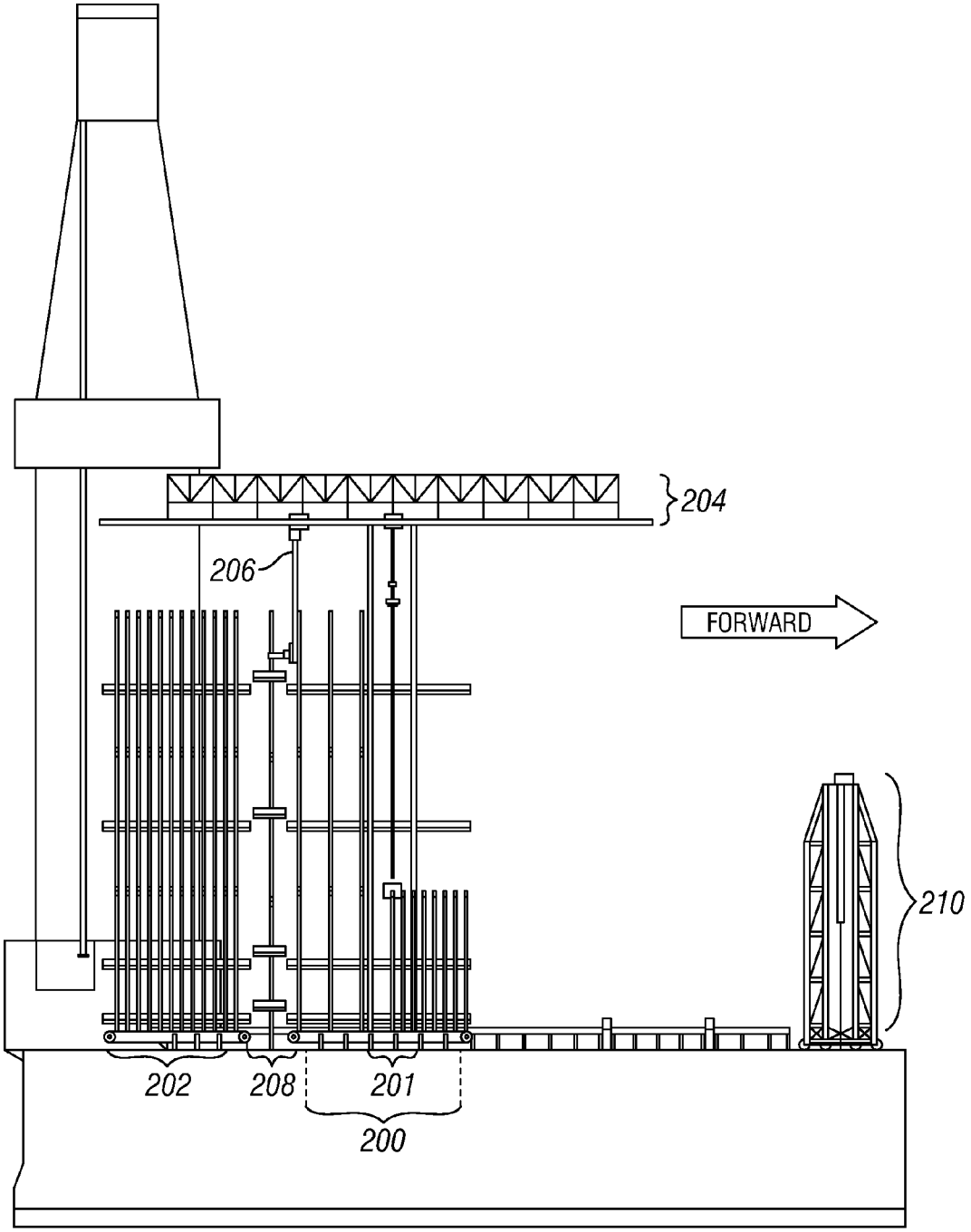
FIG. 2 is a profile view of a rig illustrating an embodiment of the pipe handling equipment.

FIGS. 2-5 illustrate different views of an embodiment of the CCDU. The CCDU is outfitted with at least one Vertical Tubular Conveyance and Standbuilding System (VTCSS), and may be outfitted with more than one VTCSS capable of operating independently in parallel, in both the forward and reverse directions, each with one or more of the following components, some of which are shown in FIG. 2: tubular standbuilding conveyor assembly 200; lower level bridge crane assembly 210; upper level bridge crane assembly 204; standbuilding hoist 206; standbuilding iron roughneck 302 (shown in FIG. 5B); tubular interchange device 208; and stand delivery conveyor assembly 202. Additional features and equipment of the CCDU may include a heavy tool store 104 in the forward end of the cantilever, a heavy lift 106 at the aft end of the heavy tool store capable of direct delivery to a conventional belt type transfer conveyor, a conventional belt type transfer conveyor on the centerline of the cantilever (shown in FIG. 3), as well as an upper deck that is flush with the drill floor (see FIG. 1). In one embodiment, a two (2) million pound open face derrick is used to accommodate the Range 2 stands (R2, approx 31' length) of triple joint drill pipe, or Range 3 (R3, approx 45' length) stands of double joint drill pipe, as well as double joint stands of casing (approx 40'-45' length). In an embodiment of the invention, the drill floor is outfitted with a 42' mousehole assembly, a 60.5" rotary support table, and a 1000 ton topdrive assembly powered by a 6000 horsepower drawworks assembly.

Figure 3:
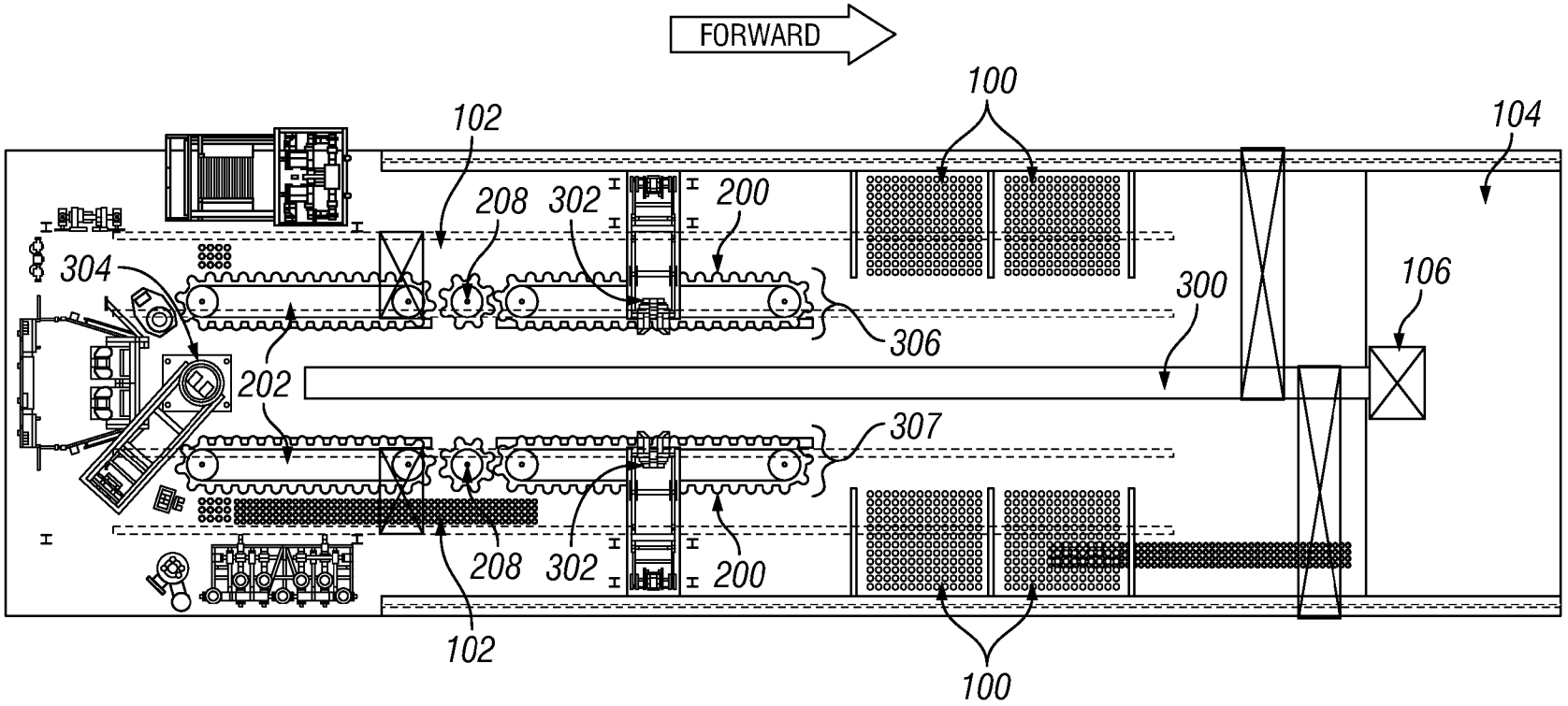
FIG. 3 is a plan view of a rig illustrating an embodiment of the pipe handling equipment.

FIG. 3 illustrates a plan view of one embodiment of the CCDU and VTCSS on the drill floor and cantilever. A conventional belt type transfer conveyor 300 runs down the centerline of the cantilever. Two VTCSS, 306 and 307, are shown in this embodiment on either side of the conventional conveyor 300 in the outboard direction from the centerline conveyor. Each VTCSS comprises a tubular standbuilding conveyor assembly 200, a tubular standbuilding station 201, a tubular interchange device 208, a stand delivery conveyor assembly 202, and standbuilding iron roughnecks 302. Tubulars are removed from doubles setback area 100 located forward of the standbuilding conveyor assembly 200 as defined by FIG. 3's reference indicator, transferred to the tubular standbuilding conveyor assembly 200 where two or more tubulars are attached to each other, and, in some embodiments three tubulars are attached to each other. Once the tubulars are attached, the tubular interchange device 208 transfers the attached tubulars to the stand delivery conveyor assembly 202 for storage in setback area 102, which is located on the aft end of the cantilever, closer to the well center 304. When needed, the attached tubulars are removed from storage and further assembled at the well center. The tubulars may also be directly transported to the well center and attached. The tubular standbuilding conveyor assembly 200, the tubular interchange device 208, and the stand delivery conveyor assembly 202 may run at the same or different speeds. The speeds of the conveyors may also be variable. For example, the tubular standbuilding conveyor assembly 200 may run slower than the stand delivery conveyor assembly 202 and the tubular interchange device 208 may run at a variable speed, allowing pickup of tubulars from the tubular standbuilding conveyor assembly 200 at the speed of the tubular standbuilding conveyor 200 and then increasing in speed to match the speed of the stand delivery conveyor assembly 202 for delivery to the stand delivery conveyor assembly 202.

The vertically stored tubulars in the doubles setback area 100 may be delivered to and from the Vertical Tubular Conveyance and Standbuilding System via the lower level bridge crane assembly 210. Upon initial loadout and standbuilding, single joints of drill pipe may require joining with other single joints to make double and triple joints. Additionally, tubulars may be loaded into the doubles setback area 100 already as doubles and triples, and may be assembled by the VTCSS into quadruples and so forth. In one embodiment, the drill pipe is R2, but the system is also capable of accommodating R3 and other drill pipe. Casing, which typically comes in 45' lengths, can also be joined from singles to doubles in this same system.

Figure 4:
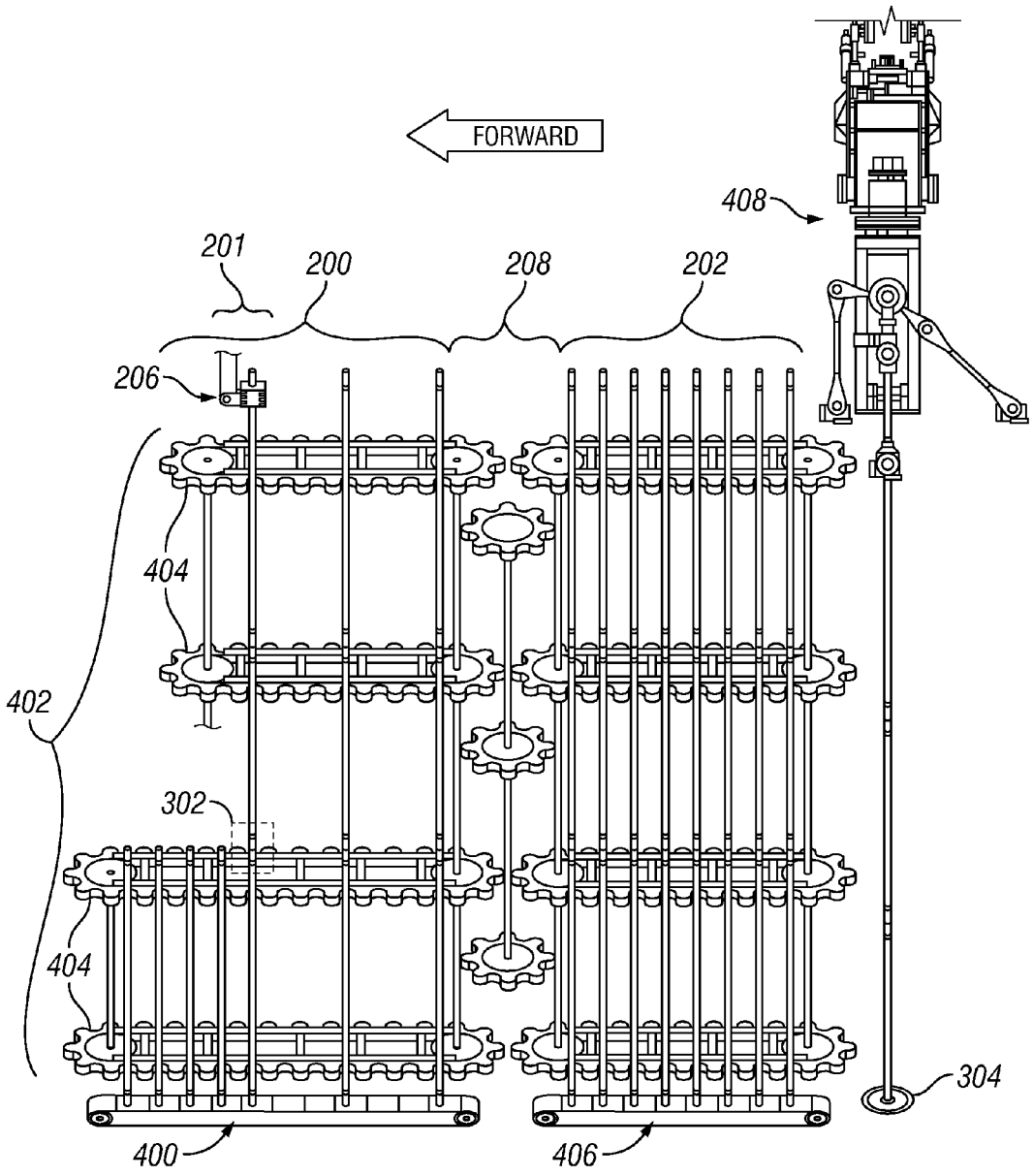
FIG. 4 illustrates an example of the tubular stand building system.
Figures 5A, 5B, 5C, 5D:
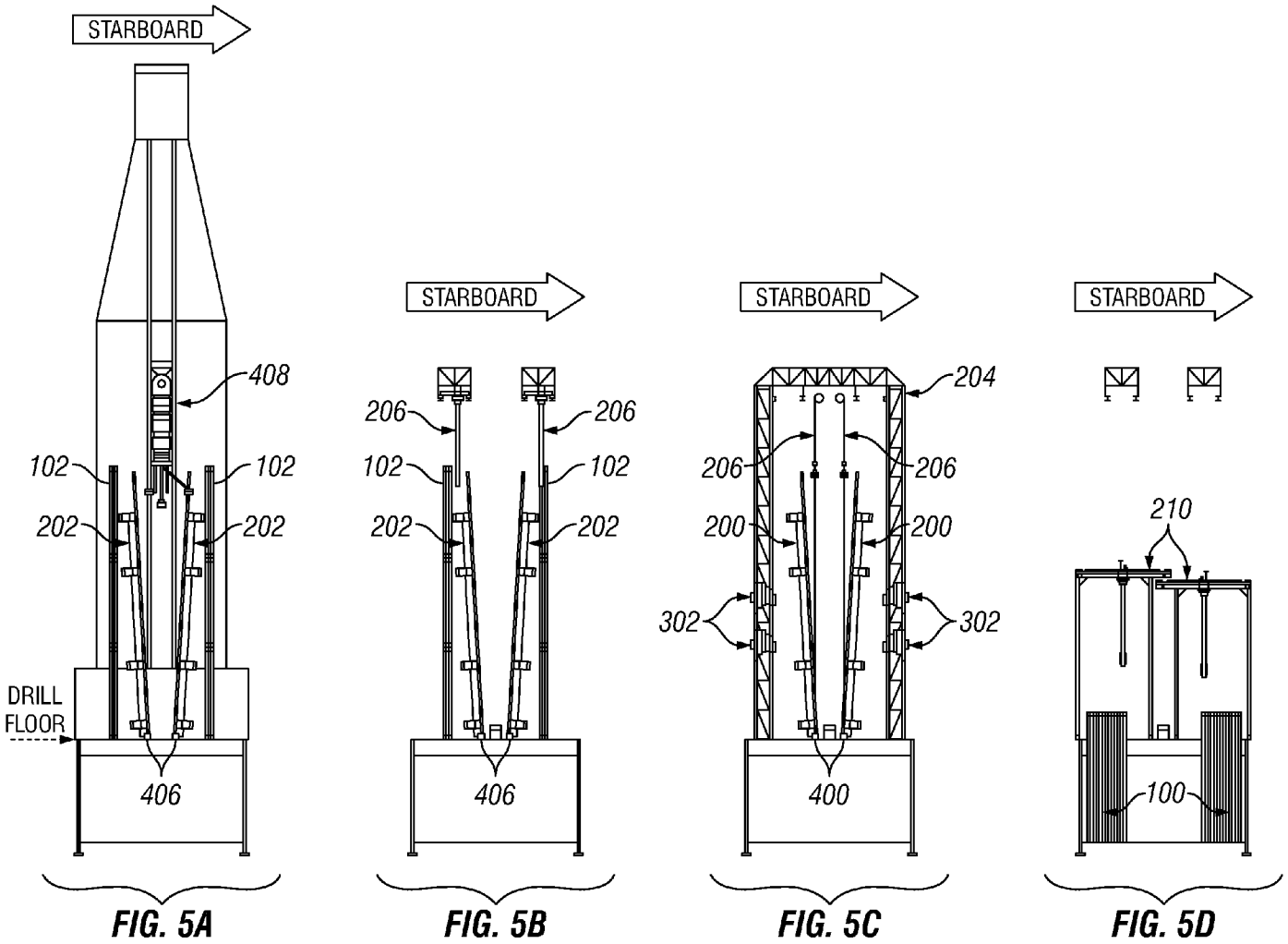
FIGS. 5A-D are end and sectional views of the rig illustrating an embodiment of the pipe handling equipment.

As shown in FIG. 4, the tubular standbuilding conveyor assembly 200 is comprised of two major components: the lower horizontal conveyor belt apparatus 400 and the vertical conveyor belt assembly 402. The vertical conveyor belt assembly 402 may comprise multiple belt assemblies 404, such as the four shown in FIG. 4. The lower horizontal conveyor apparatus 400 is a weight bearing conveyor that may be a steel track shoe belt type and is capable of supporting significant point loads. The weight bearing surface of the track shoes may be covered with a protective surface to prevent damage to tubular ends. The protective surface may be wood, nylon, rubber, or some other durable covering. The lower horizontal conveyor apparatus 400 may be mechanically coupled (timed) to an inboard vertical load bearing structure comprised of a number of parallel "cogged" belts which are part of the vertical conveyor belt assembly 402, via a set of right angle drive gears, for example. The belt assemblies 404 may be spaced and provided in sufficient number to support the weight of the tubulars as they are conveyed forward and aft between the vertical holds and the Tubular Interchange Device 208. For example, single joints may require two belt assemblies 404, doubles may require three belt assemblies 404, and triples may require the support of four belt assemblies 404.

FIG. 4 also demonstrates an embodiment of the method of tubular standbuilding and delivery. As tubulars are loaded onto the forward side of the lower horizontal conveyor apparatus 400 of the tubular standbuilding conveyor assembly 200 and advanced one position at a time, the first single joint to reach the standbuilding hoist 206 is lifted to a height safely above that of the next tubular. The lower horizontal conveyor apparatus 400 along with the belt assemblies 404 advance one tubular position to longitudinally align the suspended joint with the lower joint which is still resting on the lower conveyor apparatus 400. The lower joint is taken to the vertical position and transversely aligned with the suspended joint by a hydraulic righting arm, located near or onboard the standbuilding iron roughneck 302, which moves the tubular inboard and hands it off to the standbuilding iron roughneck 302. The standbuilding iron roughneck 302 rotates and torques the upper joint to the lower joint. This newly joined double stand is then hoisted approximately one joint length to a height safely above that of the next lower single joint in line. The lower conveyor 400 along with the belt assemblies 404 advance one tubular position, and the suspended double stand is again longitudinally aligned with the lower joint in the lower conveyor 400. The lower joint is taken to the vertical position and transversely aligned with the suspended double joint by the hydraulic righting arm which again moves the tubular inboard and hands it off to the standbuilding iron roughneck 302. The standbuilding iron roughneck 302 spins and torques up this connection to form a triple joint stand of drill pipe. The triple stand is placed back into the inboard vertical conveyor belt assembly by the hydraulic arm located near or on the standbuilding iron roughneck 302. As stands of pipe are made, they are advanced by the tubular standbuilding conveyor assembly 200 in the aft direction toward the tubular interchange device 208. As the stands reach the tubular interchange device 208, they may either be directed to continue on longitudinally to the stand delivery conveyor assembly 202, or directed to travel outboard toward the setback area 102. Conveyors in this process, as well as the setback areas, are located on the upper deck of the cantilever, which is the same level as the drill floor.

The standbuilding iron roughnecks 302 at each standbuilding station 201 may be mounted on vertically adjustable foundations to accommodate the building of double joint stands of R3 drill pipe and casing. The inboard vertical conveyor belt assemblies may be adequately spaced to accommodate R3 lengths of tubulars as well R2 lengths without any adjustment. The standbuilding process for R3 tubulars is similar to that of R2, less the addition and make-up of the third joint, for example.

The stand delivery conveyor assembly 202 may be mechanically independent of the tubular standbuilding conveyor assembly 200 and the tubular interchange device 208. The stand delivery conveyor assembly comprises a delivery horizontal conveyor belt apparatus 406 running along the horizontal axis, capable of supporting significant point loads. The horizontal conveyor belt apparatus 406 mirrors the horizontal tubular standbuilding conveyor belt apparatus 400. The weight bearing surface of the track shoes may be covered with a protective surface to prevent damage to tubular ends. In certain embodiments, the horizontal conveyor belt of the standbuilding apparatus and the delivery apparatus may be one and the same. The stand delivery conveyor assembly 202 may be populated by the tubular interchange device 208 or directly by the upper level bridge crane 204 with the standbuilding hoist 206 or an additional hoist. As such, the tubular interchange device 208 is an optional addition to the VTCSS. Whether advancing toward, or extracting from, the well center, the operation of the stand delivery conveyor assembly 202 may be dictated by the demand of the driller and operational requirements at the well center. Additionally, the operation of the VTCSS may be controlled by a computer.

The upper level bridge crane assembly 204 may be utilized to transport stands from the tubular interchange device 208 to the setback area 102. The delivery of stands from the tubular interchange device 208 to the stand delivery conveyor assembly 202 may be by direct handoff from the tubular interchange device 208 to the stand delivery conveyor assembly 202. An interlock may be employed to prevent the cycling of the tubular interchange device 208 to the stand delivery conveyor assembly 202 without a vacancy in the stand delivery conveyor assembly 202.

In the case of tripping in the hole, an assembled tubular stand is delivered to the well center when the stand in the aftermost slot of the stand delivery conveyor assembly 202 is in longitudinal alignment with the well center 304. The topdrive 408 is hoisted to a height safely above the incoming stand, then a pipehandler on the topdrive 408 is extended outboard either port or starboard to reach out and grasp the incoming tubular. As the tubular is brought toward the well center 304 by the pipehandler/topdrive 408, it is simultaneously raised while a tailing device holds the lower end of the stand and gently tails it in to transverse alignment with the well center 304. From this point the standbuilding iron roughneck 302, or an additional iron roughneck, engages the stand for final alignment and makes the connection. This newly added stand is then ready to be run into the hole. The topdrive 408 lowers the tubular (rate dependent on conditions), eventually landing it into the slips on the rotary table, and the topdrive 408 is hoisted once again to a height safely above the next incoming stand where the process repeats.

In the case of tripping out of the hole, tubulars are extracted from the well center 304 by operating the VTCSS in the reverse direction. The VTCSS is fully capable of operating in reverse order to allow for efficient breakout and removal of drill pipe from the well center 304 that will either be racked in the setback area 102, or will be sent to the tubular standbuilding conveyor assembly 200 where stands are broken down into doubles or singles, as determined by operational requirements, and stored in the vertical tubular holds 100.

FIG. 5A-D illustrates end and sectional views of the VTCSS. The tubular standbuilding conveyor assembly 200, the tubular interchange device 208, and/or the stand delivery conveyor assembly 202 may be tilted on their longitudinal axis to an angle of approximately 3 degrees from vertical, for example, with the top of the tubular leaning outboard with respect to the cantilever centerline. This tilt angle allows for the use of gravity to help retain the tubulars in the cogged belt slots. In the alternative, the upper cogged wheels of the upper conveyor belts may be fashioned of a smaller diameter to maintain said angle from vertical. A person skilled in the art would understand that additional tilt angles may be contemplated, such as 2, 4, 5, and 6 degrees, or greater.

In one embodiment, the setback area 102 will be outboard of the tubular conveyors. The tubular interchange device 208 will be capable of storing stands in all slots and discharging to both inboard and outboard. This will allow transfer of tubulars to and from the setback areas outboard of the conveyors, as well as transfer to and from the tubular standbuilding conveyor assembly 200 and stand delivery conveyor assembly 202. It would not be outside of the realm of a person skilled in the art to recognize that a setback area may also be located on the inboard side of the tubular conveyors.

Figure 6:
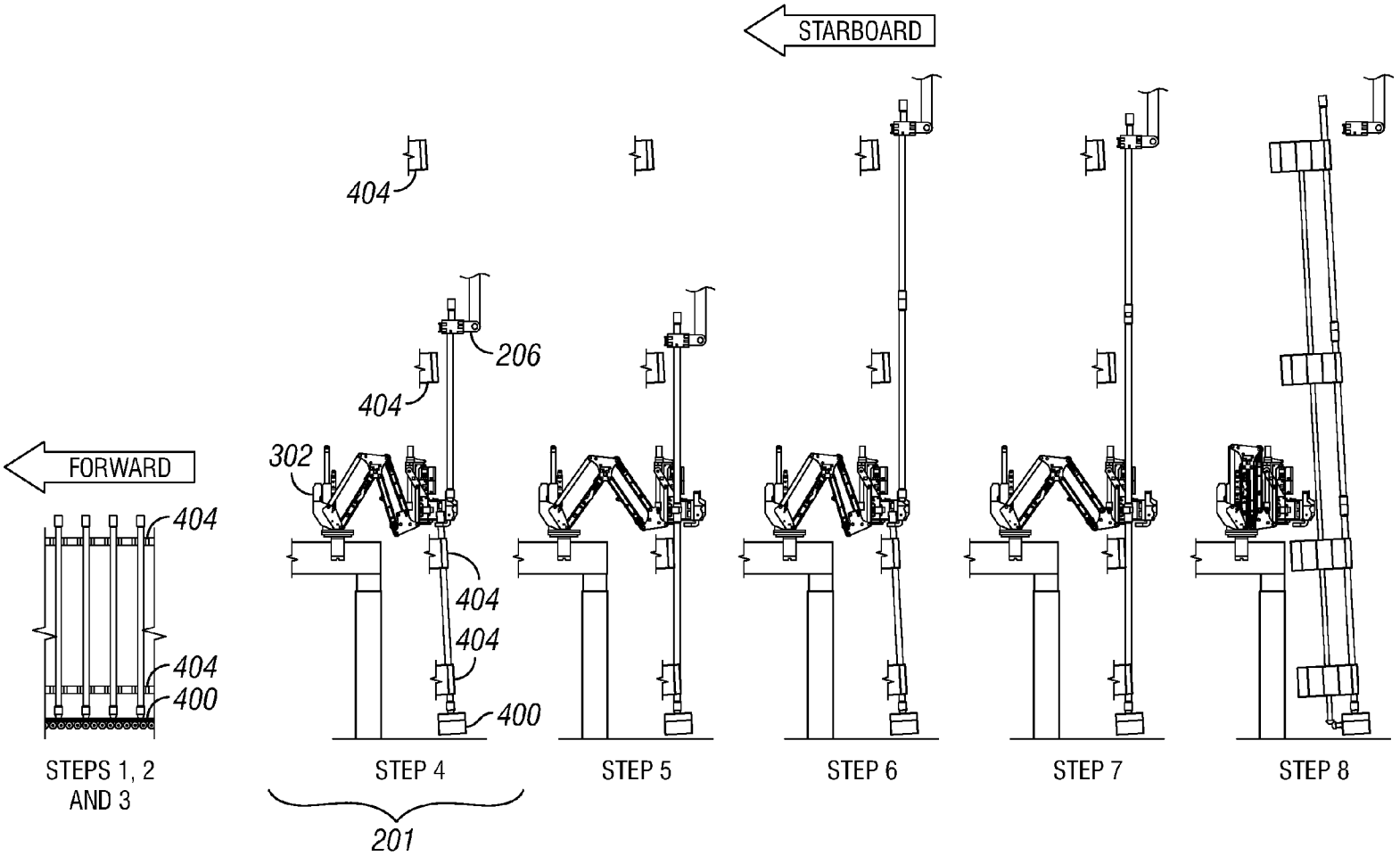
FIG. 6 illustrates an example workflow through the tubular stand building system.

FIG. 6 is a step by step view of the standbuilding method used by an embodiment of the VTCSS. In step 1, a tubular is loaded onto the lower conveyor belt apparatus 400 from doubles setback area 100 through the use of lower level bridge crane assembly 210, for example. The tubular standbuilding conveyor assembly 200 then advances one station. In steps 2 and 3, step one is repeated to allow two more tubulars to be loaded onto the tubular standbuilding conveyor assembly 200. In step 4, the first tubular arrives at the stand building station 201. The first tubular is lifted with the standbuilding hoist 206, gripped with the standbuilding iron roughneck 302, and the tubular standbuilding conveyor assembly 200 is then advanced another step to move the second tubular underneath the first tubular. In step 5, the first tubular is stabbed into the second tubular, spun and torqued with the standbuilding iron roughneck 302, such that the first and second tubulars are attached to each other and form a double tubular. In step 6, the newly made double tubular is lifted and the tubular standbuilding conveyor assembly 200 is advanced another step, moving the third tubular under the double tubular. In step 7, the standbuilding iron roughneck 302 grips the double tubular, stabs the double tubular, spins and torques the double, such that the double tubular is attached to the third tubular to form a triple tubular. In step 8, the iron roughneck 302 releases the triple tubular and lays the triple tubular back onto the tubular standbuilding conveyor assembly 200. In another embodiment not shown, the single tubulars are loaded directly into the stand building station 201, without needing to load three singles onto the tubular standbuilding conveyor assembly 200 prior to attaching a tubular.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An apparatus comprising:

a tubular standbuilding conveyor apparatus comprising:

a horizontal conveyor extending along a horizontal axis;

a first vertical conveyor oriented parallel to and vertically offset from the horizontal conveyor; and a second vertical conveyor oriented parallel to and vertically offset from the first vertical conveyor;

a standbuilding hoist; and an iron roughneck;

wherein the standbuilding hoist and the iron roughneck are configured to attach a vertically-oriented tubular to one or more other vertically-oriented tubulars; and wherein the tubular standbuilding conveyor apparatus is configured to convey at least two attached vertically-oriented tubulars along the horizontal axis.

2. The apparatus of claim 1, wherein the horizontal conveyor comprises a steel track shoe belt.

3. The apparatus of claim 1, wherein the horizontal conveyor comprises a belt having a protective outer covering.

4. The apparatus of claim 3, wherein the protective outer covering comprises at least one material selected from the group consisting of: wood, nylon, and rubber.

5. The apparatus of claim 1, wherein at least one of the first and second vertical conveyors comprises a cogged belt.

6. The apparatus of claim 1, wherein the tubular standbuilding conveyor apparatus comprises a third vertical conveyor oriented parallel to and vertically offset from the horizontal conveyor.

7. The apparatus of claim 1, wherein the first and second vertical conveyors are horizontally offset from each other such that, when a vertically-oriented tubular is disposed on the horizontal conveyor and is leaned against the first and second vertical conveyors, the vertically-oriented tubular is disposed at an angle relative to a plane extending vertically from the horizontal axis.

8. The apparatus of claim 7, wherein the angle is about 3 degrees.

9. The apparatus of claim 1, further comprising a stand delivery conveyor apparatus configured to convey one or more vertically-oriented tubulars toward or away from the tubular standbuilding conveyor apparatus.

10. The apparatus of claim 9, wherein the stand delivery conveyor apparatus comprises:

a delivery horizontal conveyor extending along the horizontal axis; and one or more delivery vertical conveyors, each oriented parallel to and vertically offset from the delivery horizontal conveyor.

11. The apparatus of claim 10, wherein the one or more delivery vertical conveyors comprises two or more delivery vertical conveyors.

12. The apparatus of claim 9, further comprising:

a tubular interchange device located between the tubular standbuilding conveyor apparatus and the stand delivery conveyor apparatus;

wherein the tubular interchange device is configured to transfer one or more vertically-oriented tubulars from the tubular standbuilding conveyor apparatus to the stand delivery conveyor apparatus.

13. An apparatus comprising:

first and second tubular standbuilding conveyor apparatuses, each comprising:

a horizontal conveyor extending along a horizontal axis; and a vertical conveyor oriented parallel to and vertically offset from the horizontal conveyor;

a standbuilding hoist; and an iron roughneck;

wherein the standbuilding hoist and the iron roughneck are configured to attach a vertically-oriented tubular to one or more other vertically-oriented tubulars; and wherein the first and second tubular standbuilding conveyor apparatuses are each configured to convey at least two attached vertically-oriented tubulars along the horizontal axis.

14. The apparatus of claim 13, wherein the apparatus is disposed on a drill floor of a drill rig.

15. The apparatus of claim 14, further comprising a forward vertical tubular setback area located forward of the tubular standbuilding conveyor apparatus.

16. The apparatus of claim 14, further comprising an aft vertical tubular setback area located aft of the tubular standbuilding conveyor apparatus.

17. The apparatus of claim 15, further comprising a first bridge crane.

18. The apparatus of claim 17, wherein the first bridge crane is configured to move a tubular from the forward vertical tubular setback area and to the tubular standbuilding conveyor apparatus.

19. The apparatus of claim 14, further comprising a second bridge crane.

20. The apparatus of claim 19, wherein the stand building hoist is attached to the second bridge crane.

21. The apparatus of claim 19, wherein the iron roughneck is attached to the second bridge crane.

22. The apparatus of claim 14, wherein each tubular standbuilding conveyor apparatus is oriented such that the horizontal conveyor is inboard of the vertical conveyor.

23. A method for assembling tubulars, the method comprising:

disposing at least first and second vertically-oriented tubulars onto a horizontal conveyor of a conveyor apparatus comprising:

a first vertical conveyor oriented parallel to and vertically offset from the horizontal conveyor; and a second vertical conveyor oriented parallel to and vertically offset from the first vertical conveyor;

raising the first vertically-oriented tubular above the second vertically-oriented tubular;

attaching the first vertically-oriented tubular to the second vertically-oriented tubular; and conveying the attached first and second vertically-oriented tubulars along the conveyor apparatus.

24. The method of claim 23, wherein the raising is performed using a stand building hoist.

25. The method of claim 23, wherein the attaching is performed using an iron roughneck.

26. A method for disassembling tubulars, the method comprising:

removing at least two attached tubulars from a well center;

disposing the at least two attached tubulars onto a conveyor apparatus comprising:

a horizontal conveyor;

a first vertical conveyor oriented parallel to and vertically offset from the horizontal conveyor; and a second vertical conveyor oriented parallel to and vertically offset from the first vertical conveyor;

separating an uppermost tubular of the at least two attached tubulars from one or more others of the at least two attached tubulars; and lowering the uppermost tubular onto the conveyor apparatus.

27. The method of claim 26, further comprising conveying the separated tubulars to a storage setback using the conveyor apparatus.

28. The method of claim 26, wherein the separating is performed using an iron roughneck.

29. The method of claim 26, wherein the lowering is performed using a stand building hoist.

* * * * *